US005213061A

United States Patent [19]

Zito

[11] Patent Number: 5,213,061

[45] Date of Patent: May 25, 1993

[54] FARRIER SQUEEZE TRAILER

[76] Inventor: Nicholas J. Zito, 7279 McCartney Rd., Coolidge, Ariz. 85228

[21] Appl. No.: 874,850

[22] Filed: Apr. 28, 1992

[51] Int. Cl.[5] ..... A61D 3/00

[52] U.S. Cl. ..... 119/101

[58] Field of Search ..... 119/98, 100, 101

[56] References Cited

U.S. PATENT DOCUMENTS

| | | | |
|---|---|---|---|
| 124,452 | 3/1872 | Shimer | 119/98 |
| 286,389 | 10/1883 | Coffey | 168/44 |
| 388,569 | 8/1888 | Martin | 168/44 |
| 457,345 | 8/1891 | Fox | 168/44 |
| 1,318,202 | 10/1919 | Garnier | 119/102 |
| 1,330,807 | 2/1920 | Ilieff | 119/98 |
| 3,053,224 | 9/1962 | Pierce | 168/20 |
| 4,762,089 | 8/1988 | McNulty | 119/137 |
| 4,770,127 | 9/1988 | Volk | 119/96 |
| 4,796,565 | 1/1989 | Charbeneau | 119/96 X |
| 4,958,594 | 9/1990 | Swagerty | 168/20 |
| 4,995,335 | 2/1991 | Wright | 119/98 |
| 5,035,204 | 7/1991 | Knoss | 119/137 |

*Primary Examiner*—John J. Wilson
*Assistant Examiner*—Thomas Price
*Attorney, Agent, or Firm*—Richard C. Litman

[57] ABSTRACT

A "Farrier Squeeze Trailer" for immobilizing hoofed animals such as horses and mules for the purpose of shoeing hooves at a comfortable height, the trailer including a flat bed, corner posts, a front wall mounted on the flat bed with an opening for passing a halter rope through to immobilize a horses head, a fixed open side frame connected to two of the corner posts, a slidable open side frame connected to a second, opposing pair of corner posts. The side frames each support a vertically and horizontally adjustable foot stand. The height of the trailer above ground level coupled with the height of the foot stand, enable a farrier to shoe a hoof without bending over by standing alongside the trailer on the ground. The immobilizing apparatus may be moved from one location to another without having to either assemble or disassemble the apparatus.

10 Claims, 4 Drawing Sheets

FARRIER SQUEEZE TRAILER

BACKGROUND OF THE INVENTION

1. Field of the Invention

The present invention relates to a device enabling the shoeing of horses or other hoofed animals in a safe, quick and easier manner. More specifically, this invention relates to a trailer having adjustable means for immobilizing a horse or other hoofed animal coupled with an adjustable foot stand suitably located on the trailer whereby a farrier may shoe horses or other hoofed animals without having to bend over.

2. Description of the Prior Art

Devices to aid horse shoeing are well known in the prior art. U.S. Pat. No. 124,452, issued Mar. 12, 1872 to John Shimer, U.S. Pat. No. 286,389, issued Oct. 9, 1883 to Wiley D. Coffey, U.S. Pat. No. 457,345, issued Aug. 11, 1891 to Fox, and U.S. Pat. No. 1,330,807, issued Feb. 17, 1920 to Ilieff disclose devices for immobilizing a horse's leg while raising the hoof to a limited degree whereby a horseshoe may be attached to the hoof. These devices are individually complex and are not disclosed to be used with other types of immobilizing devices, and their independent use could pose a danger to both a farrier and the animal.

U.S. Pat. No. 388,569, issued Aug. 28, 1888 to Samuel M. Martin and U.S. Pat. No. 1,318,202, issued Oct. 7, 1919 to Eugene Garnier disclose additional structure for immobilizing a horse with complex structure which is not easily transported from one location to another.

U.S. Pat. No. 3,053,224, issued Sep. 11, 1962 to Samuel Pierce discloses a horse trailer for transporting horses, and U.S. Pat. No. 4,958,594, issued Sep. 25, 1990 to Billy H. Swagerty discloses a trailer modified by a wall hanger assembly to carry equipment. Neither trailer discloses a device to enable the attachment of horseshoes to a horse's hoof.

U.S. Pat. No. 4,762,089, issued Aug. 9, 1988 to Robert A. McNulty discloses a device to tether a horse within a grooming stall, and U.S. Pat. No. 5,035,204, issued Jul. 30, 1991 to Doyl Knoss discloses a head restraint device for a livestock squeeze chute. Neither patent discloses a device enabling the shoeing of horse in a safe, quick and easy manner.

SUMMARY OF THE INVENTION

None of the foregoing references taken alone or in combination anticipate or suggest the invention disclosed and claimed herein. Specifically, this invention comprises mounting a slidable side frame on an open trailer together with an adjustable horseshoeing foot stand whereby a horse or other hoofed animal may be immobilized with a selected leg placed in position to be shod. The slidable side frame comprises a plurality of spaced longitudinal bars which cooperate with an open fixed side frame of the trailer configured similar to the slidable side frame. The longitudinal bars support belly straps so that the horse cannot fall down accidentally, and a butt chain. Coupled to the slidable side frame are spring biased bars having teeth on the top longitudinal surfaces which cooperate with openings in side support posts which have mating teeth engageable with the teeth on the spring biased bars to prevent the slidable side frame from releasing the horse or other hoofed animal prematurely. The slidable side frame may be mounted for sliding in any suitable manner, including, by way of example only, castors or a tongue and groove connection with the base of the trailer.

The foot stand is slidable longitudinally of the slidable side frame by means of rollers riding in C-shaped channels carried at the base of the slidable side frame, and can be locked in position by spring biased pins or ball bearings which enter holes longitudinally spaced along the channels. It is contemplated that there will be two foot stands located one on each side frame.

The additional height provided by the trailer wheels enable a farrier to shoe horses without having to bend over, by approaching the respective foot stands from the sides of the trailer. Also, by permanently mounting the immobilizing structure and foot stand on a trailer, the farrier will be able to easily transport the equipment to various locations without having to dismantle and reassemble the equipment at each location.

Accordingly, it is an object of this invention to provide an apparatus for shoeing horses and other hoofed animals which is transportable to a plurality of locations without requiring dismantling and reassembling of the apparatus at each location.

It is a still further object of this invention to provide an apparatus for shoeing horses and other hoofed animals which will enable a farrier to shoe horses and other hoofed animals without bending over.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
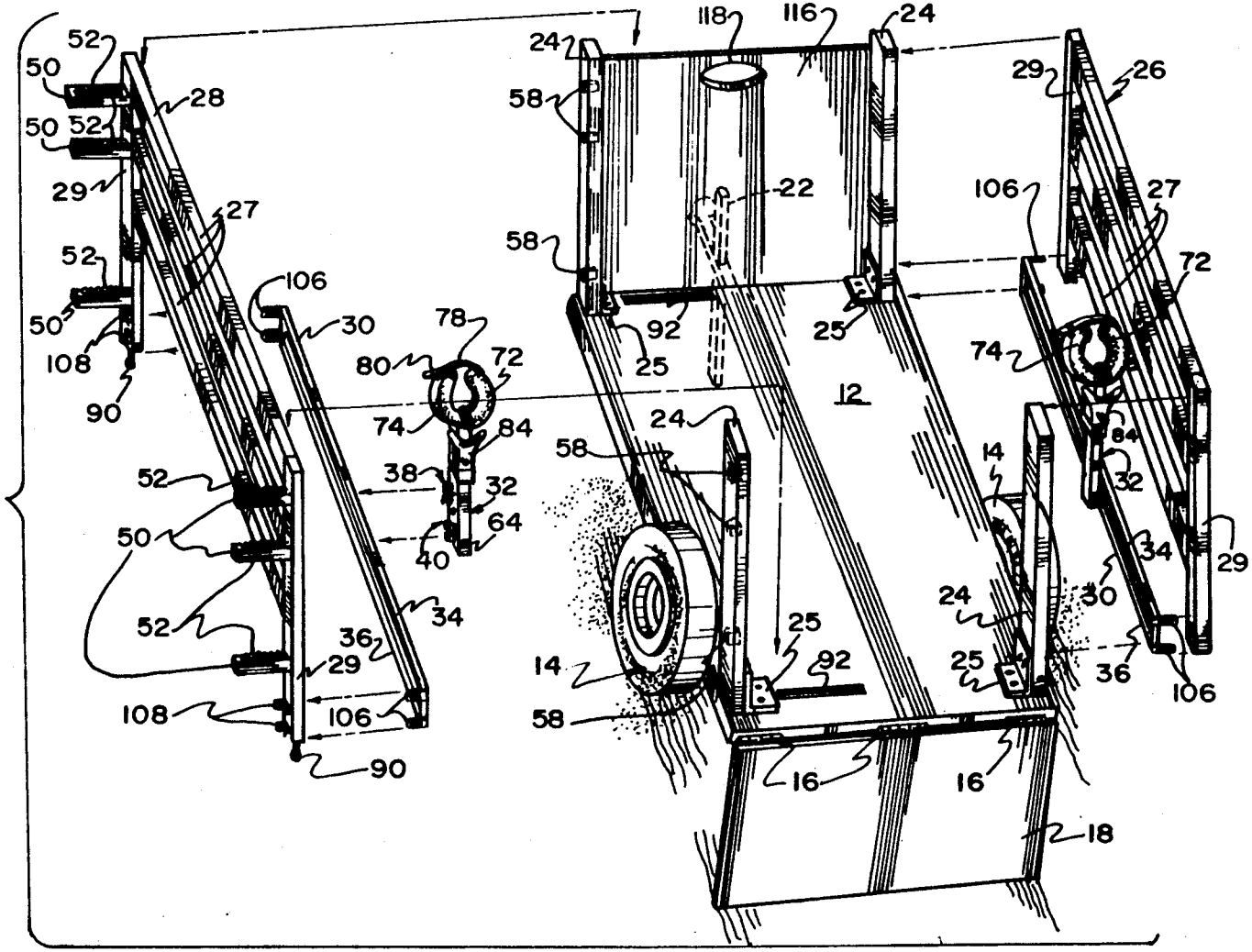
FIG. 1 is an exploded perspective view of the invention showing the relationship between the several parts.

FIG. 1 shows the "Farrier Squeeze Trailer" in an exploded fashion. The trailer 10 includes a flat bed 12 mounted on wheels 14. Connected by hinge means 16 is a rear gate or ramp 18 enabling a horse 20 to enter the trailer 10 in preparation for shoeing of the horse's hooves. When uncoupled from a towing vehicle (not shown) the trailer 10 rests on a vertical support bar 22.

Trailer 10 includes a front wall 116 having an opening 118 therein through which a halter rope (not shown) may be passed, the front wall 116 being mounted on said flat bed 12 and connected to a front pair of corner posts 24.

Figure 6:
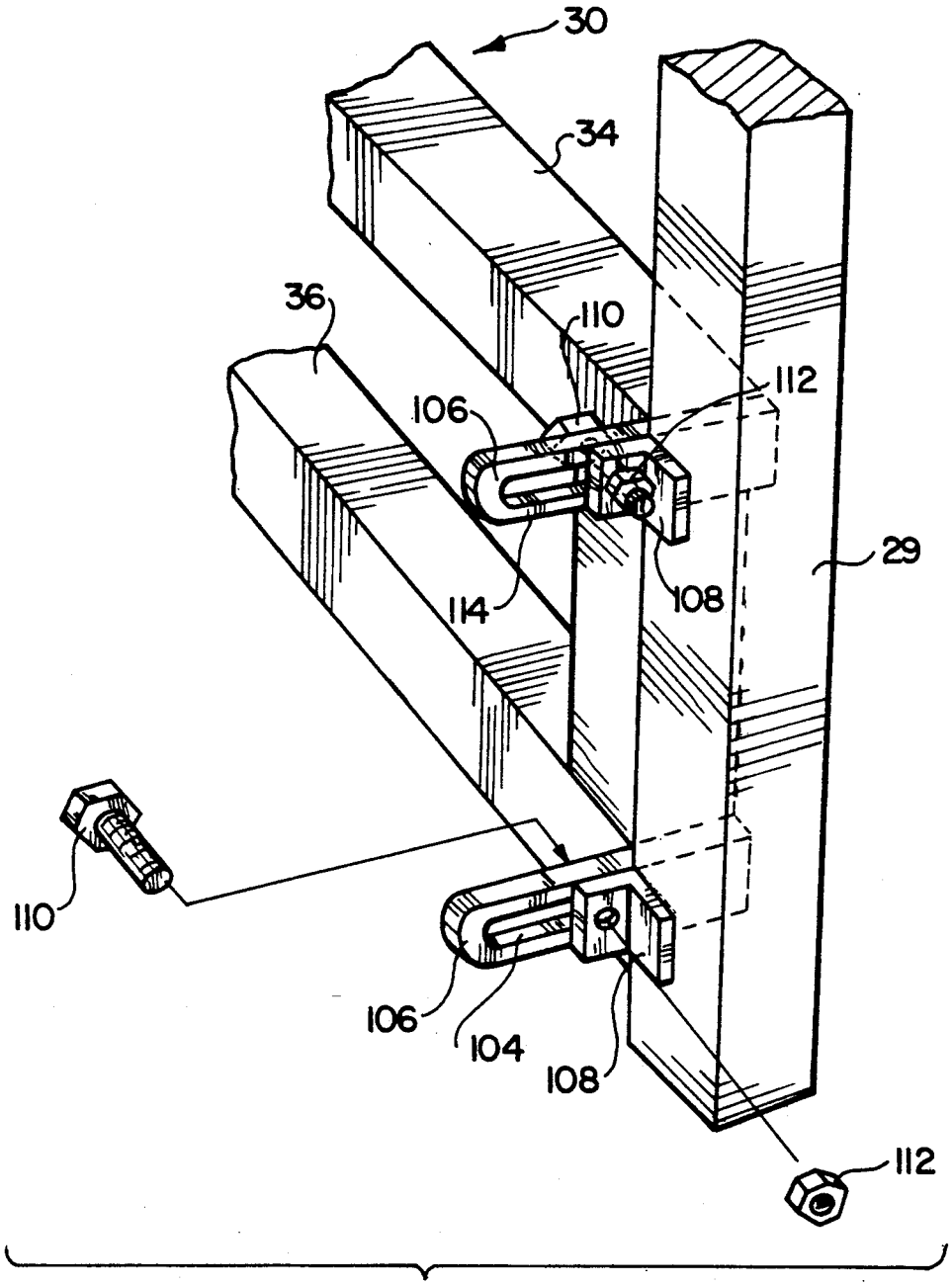
FIG. 6 is a partial perspective view showing the adjustable connection between a slider bar and a side frame.

Bed 12 supports four corner posts 24 connected by four L-shaped brackets 25. Connected to said corner posts 24 is a fixed side frame 26 on one side of the trailer 10, and a slidable side frame 28 on the opposite side of the trailer 10. Side frames 26, 28 each comprise three spaced longitudinal bars 27 integral with vertical end bars 29. Each of the side frames 26, 28 carry slider bars 30 mounted on said side frames 26, 28 to enable longitudinal adjustment of foot stands 32. Slider bars 30 include an upper track 34 and a lower track 36 for receiving an upper set 38 and a lower set 40 of wheels for each foot stand 32. Centrally located on each wheel support 46 is a spring biased pin 42 which resiliently engages openings 44 along slider bars 30 to maintain foot stands 32 in operative positions. Slider bars 30 may be adjustably mounted on side frames 26 and 28 by means of cooperating brackets 106, 108 coupled by bolts 110 and nuts 112, as best shown in FIG. 6. Brackets 106 have an elongated slot 114 and are mounted respectively on slider bars 30. Brackets 108 are mounted on vertical end bars 29 of side frames 26 and 28.

Pivotally mounted on end bars 29 of slidable side frame 28 by pivots 48 are a plurality of releasable lock bars 50 having ratchet teeth 52 on a top surface thereof. Teeth 52 are engageable, under the bias of tension springs 54, with cooperating ratchet teeth 56 formed on an upper surface of through openings 58 provided for lock bars 50 in corner posts 24. Teeth 52,56 are configured to enable slidable side frame 28 to be pushed manually towards fixed side frame 26, while preventing movement of slidable side frame 28 in the opposite direction unless lock bars 50 are pushed downwardly against the bias of springs 54 to separate teeth 52 from teeth 56.

Figure 2:
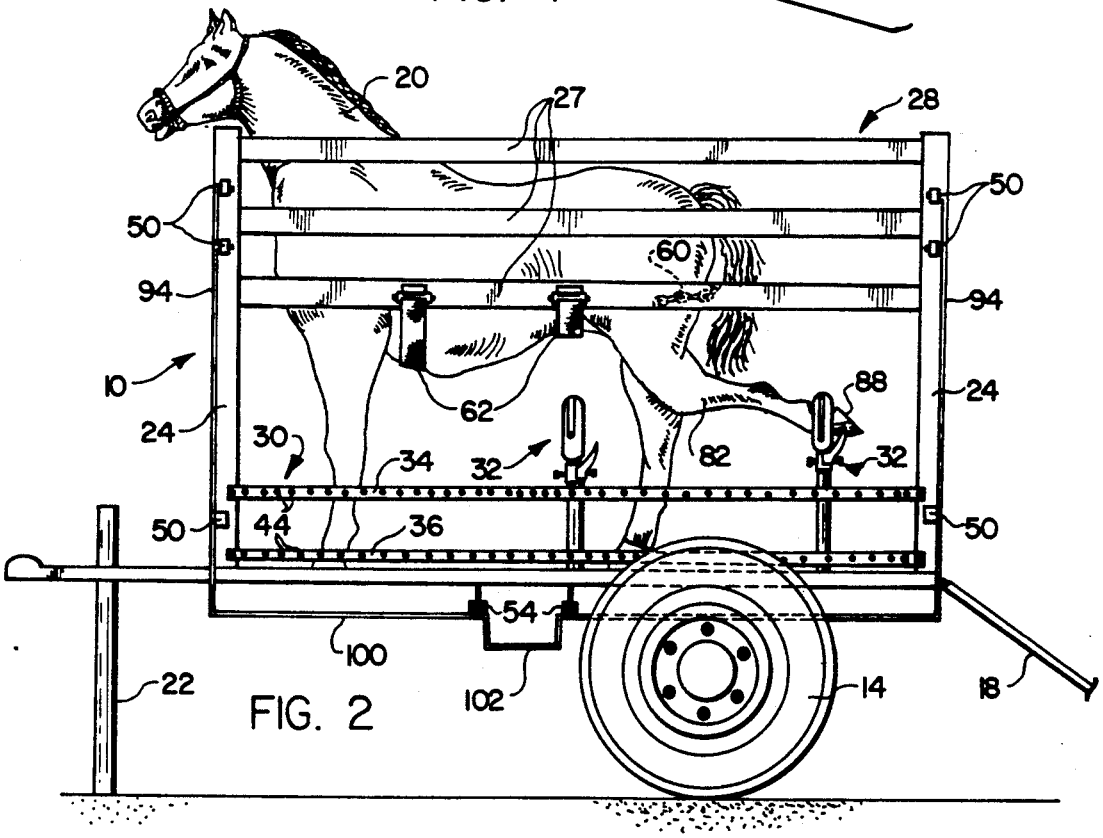
FIG. 2 is a side view of the invention showing a horse in position for shoeing.
Figure 3:
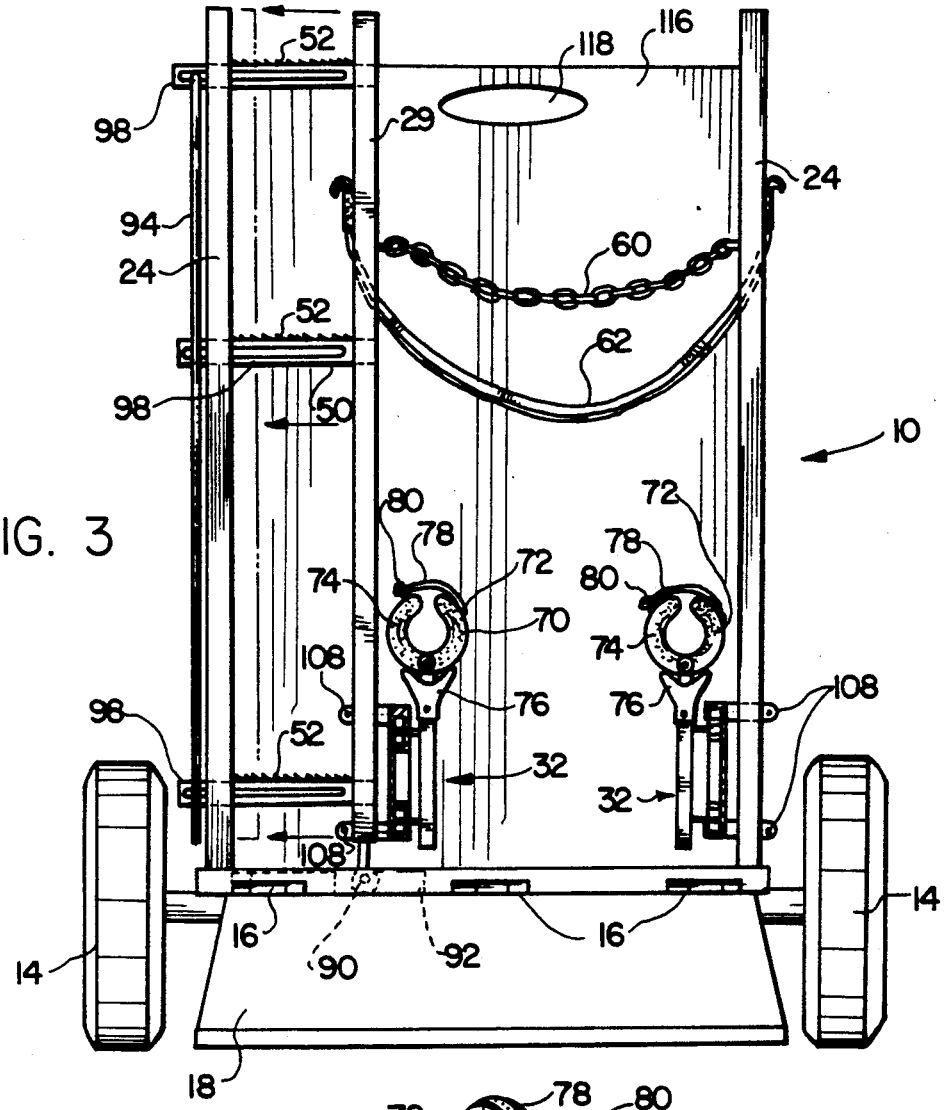
FIG. 3 is a rear view of the invention showing the relative position of the slidable squeeze bar frame relative to the trailer frame.

Frames 26 and 28 are provided with a butt chain 60 to prevent the horse 20 from backing up on the trailer 10, and belly straps 62 which are secured under the horse 20 to prevent the horse 20 from accidentally falling down. The slidable side frame 28 is provided with any suitable means to enable slidable side frame 28 to be easily slid across flat bed 12. For example, castors 90 may be provided on the base of slidable side frame 28. As shown in FIGS. 1 and 3, casters 90 move in grooves or channels 92 in flat bed 12. In the alternative a tongue and groove arrangement (not shown) or guide rods (not shown) may be provided. Once the slidable frame 28 has been pushed towards the fixed side frame 26, squeezing the horse 20 therebetween, and the butt chain 60 and belly straps 62 have been secured to frames 26 and 28, the horse 20 is immobilized as shown in FIG. 2, and ready for shoeing.

Figure 5:
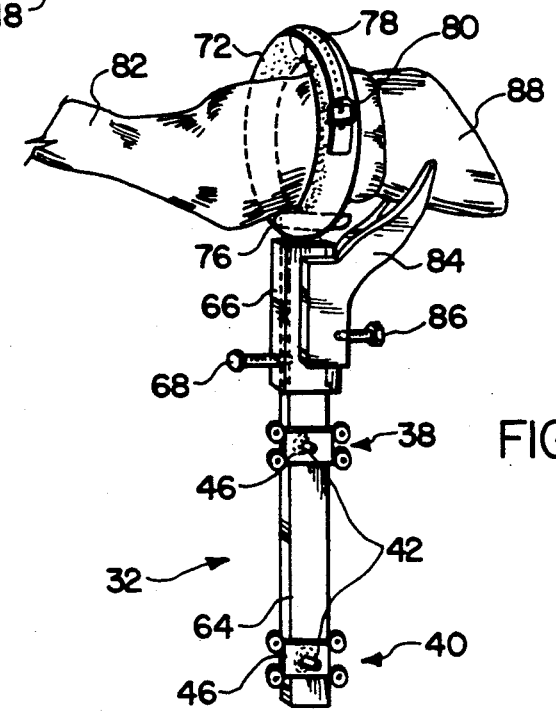
FIG. 5 is a perspective view of an adjustable foot stand.

The structure of a typical foot stand 32 mounted on trailer 10 is shown in FIG. 5. The upper and lower sets of wheels 38, 40 together with wheel supports 46 and spring biased pins 42 are shown to be suitably mounted on a vertical support bar 64 whereby foot stand 32 may be translated along slider bars 30 mounted on fixed and slidable side frames 26, 28. Near the top of vertical support bar 64 is a vertically adjustable frame 66 which may be locked in an adjusted position by means of a screw 68. Integrally carried by vertically adjustable frame 66 is a two part padded leg clamp 70 which may be opened by pivoting the two parts 72, 74 in opposite directions about pivot 76. A nylon strap 78 and buckle 80 are located at the top of clamp 70 to secure the horse's leg 82 within the clamp 70.

Slidably mounted on vertically adjustable frame 66 is a vertically adjustable hoof brace 84 which may be held in adjusted position by a second screw 86. As shown in FIGS. 1, 3 and 5, hoof brace 84 is bifurcated to form a configuration similar to a Y configuration to support a horse's hoof 88.

The "Farrier Squeeze Trailer" of this invention has a number of advantages over the prior art. As shown in the prior art, when a farrier moves from location to location to shoe horses, a horseshoeing rack must first be constructed at the site, and after the job is completed the rack must be disassembled before transporting the rack to another job site. With the squeeze trailer 10 of this invention, neither assembly nor disassembly is required. Also, transporting of the invention from one job location to another requires nothing more than hitching the trailer 10 to a suitable vehicle.

Another advantage of the squeeze trailer lies in the height of the horse's hoof 88 above the ground. In most prior art horseshoeing arrangements, the hoof 88 by necessity is located low enough that a farrier is constantly bending over during the shoeing operation. By adding the height of the trailer bed 12 to the height of the foot stand 32, the hoof 88 is more than three feet above the ground, enabling the farrier to shoe the hoofs 88 from the sides of the trailer 10 without having to bend over.

Figure 4:
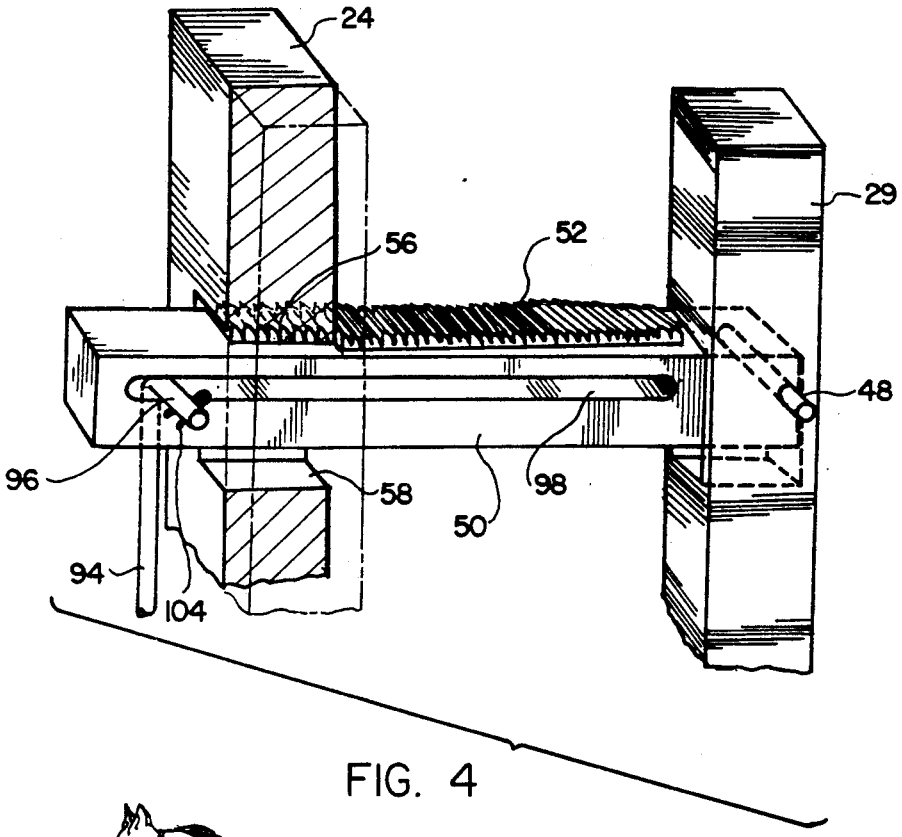
FIG. 4 is a perspective view, partly in section showing how the slidable squeeze bar frame is locked into the operating position.

The slidable frame 28 may be quickly released from its locked position, for example only, by providing a vertically disposed cross bar 94 at the front and rear of trailer 10 adjacent lock bars 50 as shown in FIGS. 2, 3 and 4. As shown in FIG. 4, each cross bar 94 has a plurality of projections 96, one projection 96 for each lock bar 50, which projections 96 are engaged in a respective slot 98 provided in lock bars 50. As shown in FIG. 2, the bottom ends of cross bars 94 are connected by a horizontal bar 100 biased upwardly by tension springs 54 and configured to provide a foot release portion 102. To release horse 20, the farrier need only push down on foot release portion 102 against the bias of tension springs 54 which in turn will pull down cross bars 94 and lock bars 50, thereby disengaging teeth 52 and 56. The slidable side frame 28 can then be pulled in a direction to release horse 20. Projections 96 may be held in their respective slots 98 by means of a cotter pin 104 as shown in FIG. 4.

While it will be apparent that the preferred embodiment of the invention herein disclosed is well calculated to fulfill the objects above-stated, it will be appreciated that the invention is susceptible to modifications, variations and changes without departing from the proper scope or fair meaning of the subjoined claims.

I claim:

1. An apparatus for immobilizing a hoofed animal for the purpose of shoeing hoofs of said animal, comprising:

a trailer having a flat bed;

four vertical corner posts attached to said flat bed;

a front wall connected to said flat bed and to a front pair of said corner posts, said front wall including an opening for a halter rope;

a rear gate hinged to said flat bed, said rear gate when open forming a ramp leading to said flat bed;

a fixed side frame attached to a first two of said four vertical corner posts on one side of said flat bed;

a slidable side frame slidably connected to a second two of said four vertical corner posts on a second side of said flat bed by a connecting means;

said connecting means including a plurality of locking bars mounted on said slidable side frame, said locking bars cooperating with openings in said second two corner posts to prevent reverse movement of said slidable side frame when said slidable side frame is pushed toward said fixed side frame; whereby a hoofed animal may be immobilized on said trailer by being squeezed between said side frames.

2. An apparatus as in claim 1, further comprising:

a butt chain means connected to said side frames to prevent said animal from backing up when said animal is on said flat bed;

belly straps connected to said side frames to prevent said animal from accidentally falling down; and at least two adjustable foot stands connected to said side frames; whereby said animal is further immobilized while on said flat bed.

3. An apparatus as in claim 2, wherein each of said side frames comprises three spaced longitudinal bars integral with two vertical end bars, and an adjustable slider bar having an upper track and a lower track for respectively receiving an upper set and a lower set of wheels mounted on each foot stand, whereby said foot stands are longitudinally translatable along respective slider bars.

4. An apparatus as in claim 3, each said foot stand comprising:

a vertical support bar;

at least two wheel supports mounted on said vertical support bar;

each of said wheel supports carrying one set of said upper set and lower set of wheels, each said set of wheels including four wheels, and a spring biased pin which engages one of a plurality of openings in said slider bars to lock the foot stand in a selected longitudinal position;

a vertically adjustable frame mounted for vertical sliding on said vertical support bar;

said vertically adjustable frame being held in adjusted position by screw means passing through a threaded opening in said vertically adjustable frame to engage said vertical bar support;

said vertically adjustable frame carrying a leg clamp formed of two parts pivoted on a pivot means so as to be openable to receive a leg of an animal, and a strap and buckle means mounted respectively on said two parts to enable closing of said leg clamp;

said vertically adjustable frame also carrying a vertically adjustable hoof brace held in adjusted position by a second screw.

5. An apparatus as in claim 4, said two parts of said leg clamp being padded;

said trailer being mounted on a pair of wheels having a radius sufficient, when added to an adjusted height of said foot stand, to enable a farrier to shoe a hoof without bending over while standing on either side of the trailer.

6. An apparatus as in claim 1, wherein:

said locking bars are pivotally mounted on said slidable side frame by locking bar pivots;

said locking bars being connected to a spring biased, foot operated releasing mechanism whereby said locking bars are biased upwardly to raise an outer end of each said locking bar upwardly to engage an upper surface of a corresponding one of said openings in a second two corner posts;

each said locking bar having teeth on an upper surface thereof cooperating with teeth located on an upper surface of a corresponding opening to thereby prevent reverse movement, said teeth being disconnected by downward movement of said releasing mechanism against said spring bias.

7. An apparatus as in claim 2, wherein:

said locking bars are pivotally mounted on said slidable side frame by locking bar pivots;

said locking bars being connected to a spring biased, foot operated releasing mechanism whereby said locking bars are biased upwardly to raise an outer end of each said locking bar upwardly to engage an upper surface of a corresponding one of said openings in a second two corner posts;

each said locking bar having teeth on an upper surface thereof cooperating with teeth located on an upper surface of a corresponding opening to thereby prevent reverse movement, said teeth being disconnected by downward movement of said releasing mechanism against said spring bias.

8. An apparatus as in claim 3, wherein:

said locking bars are pivotally mounted on said slidable side frame by locking bar pivots;

said locking bars being connected to a spring biased, foot operated releasing mechanism whereby said locking bars are biased upwardly to raise an outer end of each said locking bar upwardly to engage an upper surface of a corresponding one of said openings in a second two corner posts;

each said locking bar having teeth on an upper surface thereof cooperating with teeth located on an upper surface of a corresponding opening to thereby prevent reverse movement, said teeth being disconnected by downward movement of said releasing mechanism against said spring bias.

9. An apparatus as in claim 4, wherein:

said locking bars are pivotally mounted on said slidable side frame by locking bar pivots;

said locking bars being connected to a spring biased, foot operated releasing mechanism whereby said locking bars are biased upwardly to raise an outer end of each said locking bar upwardly to engage an upper surface of a corresponding one of said openings in a second two corner posts;

each said locking bar having teeth on an upper surface thereof cooperating with teeth located on an upper surface of a corresponding opening to thereby prevent reverse movement, said teeth being disconnected by downward movement of said releasing mechanism against said spring bias.

10. An apparatus as in claim 5, wherein:

said locking bars are pivotally mounted on said slidable side frame by locking bar pivots;

said locking bars being connected to a spring biased, foot operated releasing mechanism whereby said locking bars are biased upwardly to raise an outer end of each said locking bar upwardly to engage an upper surface of a corresponding one of said openings in a second two corner posts;

each said locking bar having teeth on an upper surface thereof cooperating with teeth located on an upper surface of a corresponding opening to thereby prevent reverse movement, said teeth being disconnected by downward movement of said releasing mechanism against said spring bias.

* * * * *